US005336155A

United States Patent [19]

Studebaker

[11] Patent Number: 5,336,155

[45] Date of Patent: Aug. 9, 1994

[54] METHOD FOR FOLDING PAPER SHEETS

[76] Inventor: Charles E. Studebaker, 5753 Greendale Dr., Galloway, Ohio 43119

[21] Appl. No.: 27,093

[22] Filed: Mar. 5, 1993

Related U.S. Application Data

[63] Continuation-in-part of Ser. No. 831,518, Feb. 5, 1992, abandoned.

[51] Int. Cl.[5] ..... B65H 45/12; B65H 45/28

[52] U.S. Cl. ..... 493/405; 493/356

[58] Field of Search ..... 493/356, 405, 406, 439, 493/455, 456

[56] References Cited

U.S. PATENT DOCUMENTS

| | | | |
|---|---|---|---|
| D. 223,640 | 5/1972 | Kemp | D19/65 |
| 793,220 | 6/1905 | O'Neill | 493/406 |
| 891,730 | 6/1908 | Pitcher | 493/406 |
| 1,192,519 | 7/1916 | Hammond | 493/406 |
| 1,217,870 | 2/1917 | Klaes | 2/21 |
| 1,229,312 | 6/1917 | Newhouse | 493/405 |
| 2,676,797 | 4/1954 | Mills | 493/406 |
| 2,712,933 | 7/1955 | Davidson | 493/406 |
| 2,997,296 | 8/1961 | La Bash | 493/439 |
| 3,713,643 | 1/1973 | Gerstenberger | 493/405 |
| 4,261,608 | 4/1981 | Bradshaw | 294/25 |
| 4,579,552 | 4/1986 | Brannlund | 493/439 |
| 4,744,196 | 5/1988 | Gallo | 53/375.4 |

FOREIGN PATENT DOCUMENTS

| | | | |
|---|---|---|---|
| 597069 | 3/1978 | Switzerland | 493/405 |
| 121638 | 12/1918 | United Kingdom | 493/436 |

*Primary Examiner*—William E. Terrell
*Attorney, Agent, or Firm*—William Weigl

[57] ABSTRACT

A method and device are provided to protect one's fingers from abrasion and paper cuts whenever forming a creasing line. The device consists of a pair of laterally-positioned elongated arms which are capable of providing a controllable creasing pressure at inwardly-facing opposed creasing surfaces. One of the arms is provided with a finger-gripping means to enable achieving a firm hold on the device during use as well as to prevent slippage of one's fingers from the device as it is moved while the crease is being formed. A stiletto-type letter opener and a sheet comber can also be provided with the device. The device can be made to stand upright on a desk for ready grasping in the identical position in which it will be used, and also has surfaces which are capable of carrying an advertising message or logo which are easily readable when the device is placed in such upright position.

3 Claims, 1 Drawing Sheet

LOGO

METHOD FOR FOLDING PAPER SHEETS

This is a continuation-in-part of my U.S. patent application Ser. No. 07/831,518 filed Feb. 5, 1992, abandoned.

BACKGROUND OF THE INVENTION

This invention relates primarily to a method and article or device for protecting a user's fingers from abrasion and paper cuts when folding and creasing paper. A common example of use is creasing a letter-sized sheet or multiple sheets into three sections to enable enclosure in a business envelope for mailing. It may also be used for forming a crease line in a sheet of paper to enable tearing or slitting along the crease line or in the Japanese folding art of origami.

When creasing a sheet in the customary manner, one known technique is to start by first doubling over a section of the sheet along one edge, pinching the starting point of the crease between one's fingers and then drawing or pulling the compressed fingertips along the line to be creased. Another known technique is to place the doubled-over sheet on a solid surface, press a finger or thumb against the paper and move either the paper or hand to make the crease. While either one of these approaches works well for a few operations, the fingers are subject to abrasion if repetitive creasing tasks are performed. Many paper stocks are coated with substances which can be very abrasive to the skin if the skin is constantly run across the paper. Additionally, paper cuts are always a risk when creasing if the user is not careful.

Creasing can also be done by using one's fingernails on both sides of a sheet, or on one side against an opposing finger. In doing either of these, however, it is often necessary to first form a fold by finger pressing along the full length of the line to be creased to assure that the crease line will not stray, then returning to the starting point of the crease, pinching the fold line between the fingernails and drawing the nails across the prefolded line. Not only does this require two passes to create a crease, it also runs some risk of snagging and damaging the paper, because of the minimal area of fingernail contact with the paper at the pressure point. The risk of a paper cut occurring is greater when creasing with fingernails rather than pressing one's fingertips together. While skin damage from a paper cut is often very slight, it can be very painful, particularly if the cut occurs beneath a fingernail.

SUMMARY OF THE INVENTION

The method and device of my invention serve to provide a manually-produced accurate, controllable-pressure crease in a single pass across the sheet, without resulting in abrasion to the person's fingertips. It comprises a pair of arms, preferably slightly flexible, connected together at a hinged portion. The arms ideally fit between the pressure points of one's thumb and forefinger when a crease is made. At least one of the arms is provided with means for preventing the fingers from slipping from the device as it is drawn along the line to be creased. Such means can take any of several different forms and can be held between a pair of fingers during the creasing action or merely be attached to one finger.

In its preferred form, the creaser also incorporates a letter opener feature for slitting open envelopes and a paper combing feature for separating individual paper sheets from the top of a pile. The creaser has arms which are V-shaped outwardly from a hinge formed at the vertex of the V. The arms are preferably naturally biased apart to permit easy placement of the V over the starting point of the crease. The arms are then pressed together by the fingers, most handily and advantageously between the thumb and forefinger, and the fingers are then drawn along the line to be creased. In one form, the device may be made of a thermosetting plastic with a living hinge at the vertex of the V. The arms are preferably of equal length so the device can be made to stand upright as an inverted V on a desk, ready to be picked up and the device immediately used as taken. A logo or advertising message may be produced on the arms and be readily viewed from either side when the device is standing upright.

The principal object of the invention is to provide a manually-operable paper folder and creaser which minimizes the effects of paper abrasion and paper cuts to the fingertips of the person performing the creasing.

An important object of the invention is to provide a method of forming a controllable-pressure crease utilizing the creaser of the foregoing object, particularly to enable obtaining either a sharp or gentle crease, regardless of the number of sheets being creased.

Another object is to provide such a creasing device with a gripping means for resisting or preventing slippage of one's fingers from the device while performing a creasing function.

A further object is to provide such a device which can be used for folding and creasing with the device held in either the right or left hand.

Still another object is to provide an efficient means for simultaneously creasing a plurality of sheets with ease and accuracy.

A further object is to provide a creasing device which improves the capability of creasing a sheet of paper for use as a tear line, and which is capable of providing a finer tear line than when using conventional finger creasing techniques.

Yet another object is to provide a creasing device which is capable of easily carrying an advertising message or logo, whereby the device can be used as a promotional item for products with which the creaser is associated.

Another object is to provide such a device which can be made to stand on a desk of other surface, ready to be used in the position in which it is picked up.

A further object is to combine portions of the creasing article of the invention with means capable of performing other functions, such as slitting open envelopes or combing individual sheets from the top of a pile, all while the article is held in the same manner regardless of which task is being performed.

Other objects will become apparent from the following description in which reference is made to the accompanying drawings.

IN THE DRAWINGS

DETAILED DESCRIPTION

Figures 1, 2, 3, 4, 5, 6, 7, 8, 9, 10:
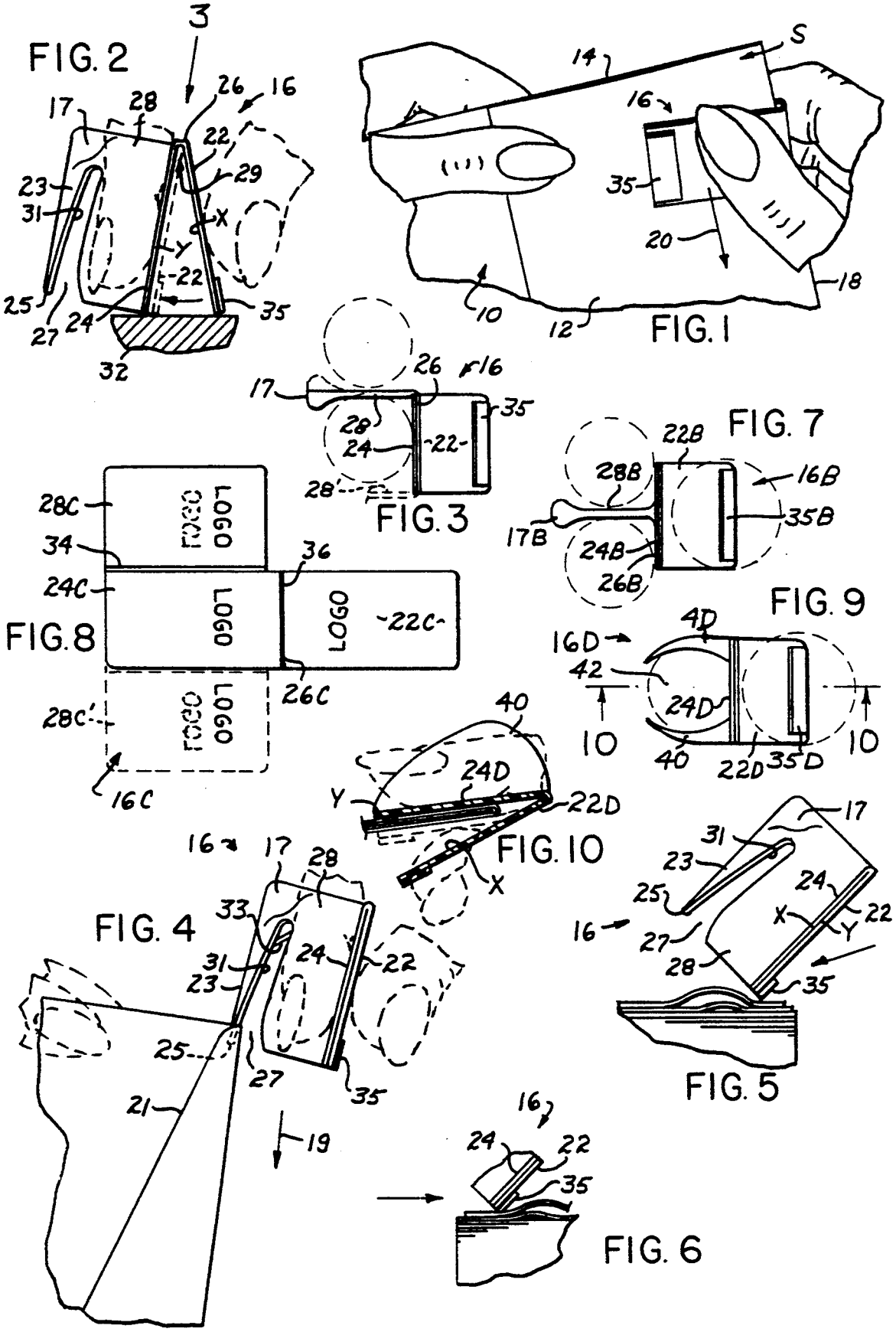
FIG. 1 is a pictorial depiction of a preferred form of my creaser being drawn along a line to be creased by a user's hand while the paper is held between a person's thumb and forefinger of the other hand.
FIG. 2 is a side view of the preferred form of my invention, illustrating the manner in which the creaser is grasped while it is standing upright on a horizontal surface.
FIG. 3 is a top view of the combined creaser/slitter/-comb of FIG. 2 taken looking essentially in the direction of the arrow 3 of FIG. 2.
FIG. 4 illustrates the device of FIGS. 2 and 3 as it is held and used for slitting open an envelope.
FIG. 5 is a view of the device performing a combing function on a pile of sheets by pushing the device away from the user.
FIG. 6 is a fragmentary view of the device performing a combing function on a pile of sheets by drawing the device toward the user.
FIG. 7 is a view of a modified form of the combined creaser/slitter/comb looking substantially in the same direction as in FIG. 3.
FIG. 8 illustrates one simplified form of creaser as produced from a flat sheet of plastic or heavy paperboard and printed with a logo on any or all of several outwardly-facing sides.
FIG. 9 illustrates still another modification of the creaser looking substantially in the same direction as in FIG. 3.
FIG. 10 is a cross-sectional view of the device of FIG. 9 and is taken looking in the direction of lines 10—10, illustrating how the creaser performs on multiple sheets of paper.

A sheet of paper 10 to be creased has a doubled-over flap 12 of a preselected width pinched between a person's left thumb and forefinger to hold the paper. As is customary, the right thumb and forefinger also pinch the starting point S of a line 18 to be creased and then are drawn away from an edge 14 of the sheet to create the crease. Let it be understood that the word "fingers" are used generically herein to encompass any five fingers of a hand, including a thumb. This is necessitated due to the fact that it is possible to employ the device of my invention with fingers other than a thumb, although the desired controllable creasing pressure is believed best developed between a thumb and forefinger. It should also be understood that the crease line 18 can be formed either right or left handed according to the person's inclination and preference. Several illustrated versions of the device may be used with either hand. Those that cannot be used ambidextrously can be manufactured for use by either a right-handed or left-handed person.

A finger-protecting creasing device 16 is shown as being held between the thumb and forefinger of the right hand to pinch the sheet 10 at point S and apply pressure to the crease line 18. The device 16 is then drawn in the direction of arrow 20 in very much the same fashion as can be customarily done between one's finger and thumb tips. The paper can be creased with controllable thumb pressure applied directly over line 18 for a sharp or somewhat sharp crease, or the crease can be made closer to the throat of the device (with the thumb and finger tips inwardly of the line 18) with reduced pressure being applied, if a more gentle crease (less sharp) is desired.

The device 16 of the preferred form of my invention is shown in FIGS. 2–6. It consists of a pair of slightly flexible arms 22 and 24, a hinge portion 26 and at least one side wing or flange 28. Ideally, parts 22, 24, 26 and 28 are integral and made of plastic for purposes of long life, but it can also be made of several components and of other materials. The hinge, when the device is made of plastic, may be a conventional "living hinge" with a throat portion 29. Considered within the scope of the term hinge is anything which allows the device 16 to be open (V-shaped) at the end opposite the hinge for placement over a line to be creased when the device is inactive, and then permit arm 22 to be relatively movable toward arm 24 to an active creasing condition to the dotted line positions shown in FIGS. 2 and 10. In such creasing condition, arms 22 and 24 are essentially parallel, at least at the section where finger pressure is applied. A flexible arm such as illustrated in FIG. 10 may be considered hinged for purposes of this invention, for example. The arms 22 and 24 have opposing facing creasing surfaces X and Y, which, when the arms are brought together as in FIGS. 2 and 10, establish a fairly large area of surface contact between the creasing surfaces and the sheet being creased.

The preferred form of article shown in FIGS. 2–6 also incorporates an envelope-opening feature and a paper combing feature. Envelope opening is performed by slitting with a stiletto-type guide 23 having a pointed tip 25 and an opening 27 extending lengthwise between the guide 23 and the adjacent edge of flange 28. The guide 23 may have a sharpened edge 31, and may even be provided with an embedded razor edge 33 (FIG. 4), or can have both. As the function of such an envelope opener is well known, it need not be further described here, except to say that the envelope would be slit by entering tip 25 into an open corner below a flap 21 as shown in FIG. 4, with the guide 23 then being moved in the direction of arrow 19. A bulbous portion 17 may be provided on one or both sides of the end of the guide 23 opposite from tip 25 to spread the envelope during slitting.

In addition, a resilient friction-creating comb or snubber 35 is provided at the cantilevered end on the outer surface of the arm 22, and is used to comb sheets by either pushing them in from a pile edge as shown in FIG. 5 or pulling them in as shown in FIG. 6.

For ease of picking up device 16 as well as using it for display purposes to be described later, arms 22 and 24 are desired to be of the same length. This enables the device to be stood upright on a surface 32, e.g., the top of a desk (FIG. 2). When so standing and with the flange 28 being located away from the user, it becomes simple for the person to place the forefinger and middle finger over the flange 28, capture it between those fingers and lift it into ready position for placement over a sheet fold and creasing it. Finger placement is depicted in FIG. 3, where the two dotted-line circles on opposite sides of the flange 28 are representative of the forefinger and middle finger. The thumb is also shown in dotted lines, ready to apply pressure to the arm 22 and sheet 10 at the crease line 18. This is accomplished by relatively pressing arm 22 and arm 24 toward each other in a pinching-type motion. The reason I have illustrated a thumb against arm 22 in FIGS. 1–3 is that greater pressure can normally be applied by a thumb as compared to a finger, such as when folding and creasing multiple sheets. The thumb also seems better able to control the amount of pressure applied, depending on how little or how much pressure is desired to form a specific sharpness of crease. FIG. 3 shows a flange 28' in dotted lines. Both flanges 28 and 28' may be used on the device to make it usable by either a right or left handed person. When two flanges are used, the flanges tend to grip the sides of the forefinger lightly and keep the device from falling from the user's hands if other tasks are also being undertaken while creasing is intended to continue.

FIG. 7 illustrates a slight modification from the preferred form of device. In this version, the flange 28B is located centrally of arm 24B. This makes a single flange readily usable by either a right or left handed person. It will be noted from several of the views that the outer tips or ends of the arms 22 and 24 are perpendicular to the length of the arms, making them squared or blunt. This is what enables the device to stand upright and vertically on surface 32, in inverted V fashion. Flange 28B is easily gripped between the forefinger and middle finger in the same manner as the flange of device 16.

FIG. 8 illustrates one simple manner in which a version of the device 16C dedicated solely to creasing can be produced, with or without the addition of the flange 28C'. It can be made from flat stock and thinned out at 34 and 36 to form a right angled portion and the hinge. A logo or advertising message may be printed or otherwise formed in what will become the outer surfaces of arms 22C and 24C when the device is made to stand on the surface 32. The logo may also be on the outer side of either or both flanges 28C, 28C'. The creases 34 and 36 may be designed so that flange 28C and arms 22C and 24C adopt their positions of FIGS. 2 and 3, while still allowing the hinge 26C to perform its function.

Flanges 28, 28B and 28C also constitute a slippage-resisting gripping means to maintain the device firmly under control as it is drawn along the crease. In effect, the flanges are a positive means to prevent the fingers from sipping off the device. However, it is also contemplated that frictional means on the outside surfaces of arms 22 and 24 may also perform to some extent, although not as well.

FIGS. 9 and 10 show another modified form of creasing device 16D. FIG. 9 is a view taken from above, looking in the same direction as in FIGS. 3 and 7, while FIG. 10 is a cross-section of FIG. 9 taken along lines 10—10. This version has a ring portion 40 which may be open as at 42 to accommodate fingers of different diameters. Clearly, this variation is best molded from thermoplastic, one having sufficient resilience to enable expansion and contraction to be received by large or small fingers. FIG. 10 illustrates multiple sheets being creased, e.g., a multi-part computer form. Arm 22D is shown somewhat flexed adjacent the hinge end, this showing being exaggerated to illustrate what can occur when a simple bend forms the hinge and the arm 22D is capable of slight flexing.

Whether the device is dedicated solely to creasing or also includes the envelope opening or sheet combing features, it is always held the same way. This is illustrated by the dotted-line fingers in FIG. 2 and 4. It should be understood that the same manner of finger gripping is also used when sheet combing as in FIGS. 5 and 6.

Depending on the particular form of device, one or more exposed surfaces can carry a logo or advertising message (FIG. 8). Since the device can be made to stand upright on the blunt ends of the arms for grasping by the user, the logo should be made to be readable when the device is upright. This advantageously exposes the user to frequent sight of the logo. This makes the device an exceptional promotional item for products and services associated with business use.

It can be seen that my invention lends itself to many differently-designed forms, and the illustrated forms are not intended to limit the claims only to those variations shown. Various other modifications can be made without departing from the spirit and scope of the method and article claimed.

Having described my invention, I claim:

1. A method of manually forming a crease in a sheet of paper comprising the steps of:

providing a creasing device comprising a first creasing arm, a second creasing arm laterally alongside said first arm, a hinged portion connecting two adjacent ends of said first arm and said second arm, and means for finger-gripping the device; said arms having a first open, inactive non-creasing condition in which said arms form an acute angle extending from said hinged portion to an open end remote therefrom and a second active creasing condition in which facing inner creasing surfaces of said arms are pressed against paper to be creased by means of inwardly-directed pressure applied to said arms;

gripping the gripping means with at least one finger of one hand;

doubling over a portion of said paper sheet to establish a line to be creased;

grasping the double-over sheet portion from opposite sides in the hand other than said one hand gripping the device;

pinching a starting point for said crease at one end of said doubled-over sheet portion;

placing the open end of the arms, while said arms are in their inactive condition, over opposite sides of the line to be creased in said paper sheet with said line being essentially between said facing creasing surfaces of said arms;

applying inwardly-directed pressure to the doubled-over portion at said starting point by moving said arms to their active creasing condition; and manually moving said device away from said starting point in a direction along the line to be creased while maintaining the pressure applied to said arms to form the creasing line.

2. A method according to claim 1 wherein the pinching occurs at the time the pressure is applied to said arms to press the doubled-over portion together.

3. A method according to claim 1 wherein said at least one finger is a forefinger, and wherein pressure is applied to move the arms to active creasing condition by said forefinger and its adjacent thumb.

* * * * *